United States Patent [19]

Elder et al.

[11] 4,431,948

[45] Feb. 14, 1984

[54] APPARATUS FOR CONTROL OF LOAD POWER CONSUMPTION

[75] Inventors: Delbert E. Elder, Santa Ana; Gerald F. Forder, San Gabriel; Albert J. Donnelly, Santa Ana, all of Calif.

[73] Assignee: Standun Controls, Inc., Santa Ana, Calif.

[21] Appl. No.: 406,410

[22] Filed: Aug. 9, 1982

[51] Int. Cl.[3] ..... H05B 41/38

[52] U.S. Cl. ..... 315/276; 315/141; 315/288; 315/291; 315/362; 315/DIG. 4; 323/345

[58] Field of Search ..... 315/137, 141, 142, 265, 315/276, 291, 293, 288, 362, DIG. 4; 323/209, 210, 344, 345, 910

[56] References Cited

U.S. PATENT DOCUMENTS 3,014,173 12/1961 Martin et al. ..... 323/344
4,134,043 1/1979 Nuver ..... 315/276 X
4,189,664 2/1980 Hirschfeld ..... 315/276 X
4,390,814 6/1983 Peek ..... 315/362 X

*Primary Examiner*—Eugene R. LaRoche
*Attorney, Agent, or Firm*—Fischer, Tachner & Strauss

[57] ABSTRACT

An apparatus for reducing the voltage applied to a load in an AC system utilizes an autotransformer and a relay or equivalent switching device between the common winding and the series winding. In each of the AC lines, the common winding and relay are connected between the load and the AC common while the series winding is connected between the input and the output. The relay is normally open to pass substantially full input voltage to the load, but when closed the relay permits current flow in the common winding to reduce voltage to the load. The relay or equivalent switching is therefore not in the direct flow of load current and can be of lower current rating and smaller size and cost as compared to prior art voltage reduction systems.

10 Claims, 6 Drawing Figures

APPARATUS FOR CONTROL OF LOAD POWER CONSUMPTION

BACKGROUND OF THE INVENTION

1. Field of the Invention

The present invention pertains generally to apparatus for controlling the voltage applied to a load for purposes of conserving power and more specifically, to an improved transformer apparatus for advantageously lowering the voltage applied to a load such as a bank of fluorescent lights after initial turn on of such lights.

2. Prior Art

The present invention is particularly suited to the function of permitting the application of a normal high voltage to a lighting load such as a bank of fluorescent lights and to thereafter, selectively reducing the voltage to maintain such lights in a lighted condition but with reduced power consumption. The general concept of voltage reduction for the aforementioned purpose is well-known in the art. By way of example, U.S. Pat. No. 2,429,162 issued Oct. 14, 1947 to Kaiser et al discloses a number of alternative transformer configurations utilizing a variety of switches and relays. These configurations permit the application of a nominal voltage to a plurality of fluorescent lamps followed by a reduction in that voltage subsequent to lamp lighting in order to maintain the lamps in a lighted condition at a reduced power consumption. A more recent patent, No. 4,189,664 issued Feb. 19, 1980 to Hirschfeld, discloses another type of transformer configuration utilizing a switch for selectively applying one of a plurality of taps from an autotransformer to a lighting load to reduce the voltage delivered to the load and to thereby reduce the power consumed by the load.

The prior art concepts which utilize an autotransformer and a switching means for either selectively applying one or more taps of the transformer to the load or shorting portions of the autotransformer for controlling the voltage applied to the load, do indeed serve the aforementioned purpose of reducing power consumption in a lighting load but unfortunately suffer from a number of disadvantages which the present invention is designed to overcome. By way of example, in such prior art disclosures, the switch unit that is used to control the voltage applied to the load, is normally interposed between the input power and the load. As a result, it must be capable of supporting the entire load current on either the input or output terminals of the autotransformer. Accordingly, to withstand such high carrying current requirements, such switching devices must be large and bulky and are commensurately expensive. The high cost of such units tends to defeat the cost saving aspect of power consumption reduction thereby reducing the consumer's motivation for employing such power reduction systems in the first place.

A number of other patents that disclose the use of relay-controlled transformer windings include the following:

U.S. Pat. No. 2,180,193—Brand

U.S. Pat. No. 2,853,654—Swasey

U.S. Pat. No. 3,652,824—Okada

Although these three additional prior art disclosures are not as relevant to the present invention as the two prior art disclosures previously discussed, it is to be noted that in each case the disclosure relates to a relay-controlled transformer mechanism in which at least one relay or equivalent switching device is interposed in the direct path between the input power and the output power to the load, thereby suffering the aforementioned disadvantages of the prior art.

SUMMARY OF THE INVENTION

In the present invention the aforementioned disadvantages of the prior art are entirely overcome or substantially reduced by means of a novel combination of transformer and switching device such as a relay. More specifically, in the present invention the selective reduction of voltage applied to a load such as a lighting load, for purposes of reducing power consumption, is provided by the unique concept of utilizing an apparatus in which an autotransformer is connected in series relationship with a switching device such as a relay.

A portion of an autotransformer winding is interposed between the input and output and an additional portion of the transformer winding is interposed between the output and the common terminal of an alternating current power system. The winding interposed between the input and the output, is hereinafter referred to as the series winding of the autotransformer, and the portion of the winding interposed between the output and the common terminal, is hereinafter referred to as the common winding of the autotransformer.

A relay or equivalent switching device is connected in series with the common winding so that when the relay or equivalent switching device is in its open configuration, no current can flow in the common winding and the output voltage is substantially equivalent to the input voltage less any nominal voltage drop across the relatively low impedance of the series winding. On the other hand, when the relay or equivalent switching device is closed, the current is permitted to flow in the common winding and the transformer performs its normal function as an autotransformer with the output voltage reduced relative to the input voltage in accordance with the well-known operation of an autotransformer.

It will be seen hereinafter that the relative placement of the relay in series with the common winding is advantageous from another standpoint, namely, by connecting at least a portion of the common winding directly to AC common, it becomes unnecessary to break AC common which is frowned upon by most regulatory and testing agencies. It will also be seen hereinafter that because the relay or equivalent switching device is not in the direct path of the load current on either side of the transformer, as previously mentioned with respect to the prior art, the actual current handling capacity of the relay or equivalent switching device need only be a fraction of what would otherwise be required to accomplish the voltage reduction in accordance with the teachings of the prior art. It will also be seen hereinafter that alternative embodiments of the present invention may be provided to permit selection of any one of a plurality of different reduced voltage levels while still providing the advantageous reduced current operation that affords the aforementioned advantage of the present invention as compared to the prior art.

OBJECTS OF THE INVENTION

It is therefore a principal object of the present invention to provide a voltage reduction apparatus for reducing power consumption in loads such as a bank of fluorescent lights and which obviates the disadvantageous prior art requirement of interposing a switching device in the relatively high current carrying path between a source of input power and the load.

It is a further object of the present invention to provide a voltage reduction apparatus for reducing power consumption to loads such as a plurality of fluorescent lights wherein the current carrying capacity of the switching device which is provided for voltage reduction may be only a fraction of the current carrying capacity of switching devices used in accordance with the prior art for carrying out the aforementioned function.

It is still a further object of the present invention to provide a voltage reduction apparatus for decreasing power consumption in a load, which apparatus employs a combination comprising an autotransformer and a relay or equivalent switching device in series with a portion of such a transformer.

It is still a further object of the present invention to provide a voltage reduction apparatus for decreasing load power consumption and in which such apparatus may be used in either single phase or multi-phase alternating current power systems and wherein the apparatus comprises an autotransformer and a relay or equivalent switching device in series with at least a portion of the transformer winding. That portion of the transformer winding is interposed between the output and the common terminal of the AC system wherein opening of the relay interrupts the current that would otherwise flow in such a portion of the winding.

BRIEF DESCRIPTION OF THE DRAWINGS

The aforementioned objects and advantages of the present invention, as well as additional objects and advantages thereof, will be more fully understood hereinafter as the result of a detailed description of the invention when taken in conjunction with the accompanying drawings in which.

DETAILED DESCRIPTION OF THE INVENTION

Figure 1:
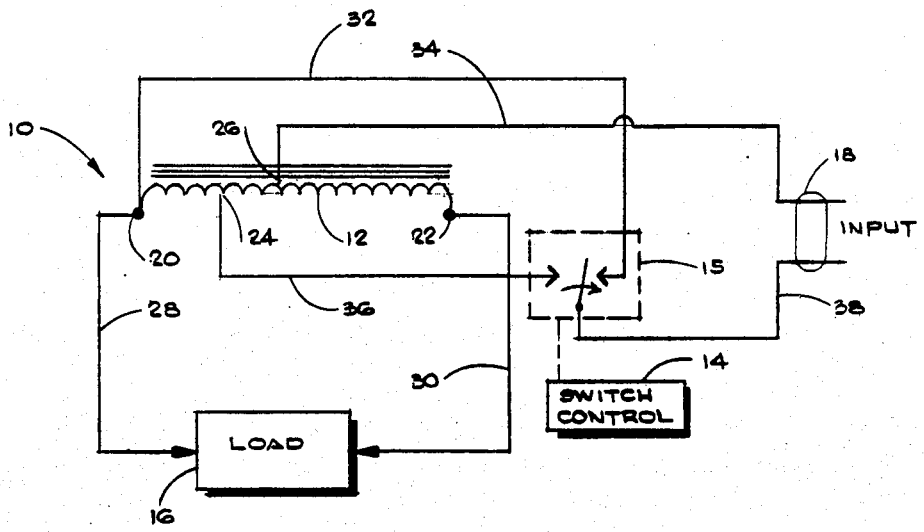
FIG. 1 (PRIOR ART)
FIGS. 1 and 2 are schematic block diagrams of prior art voltage reduction systems.
Figure 2:
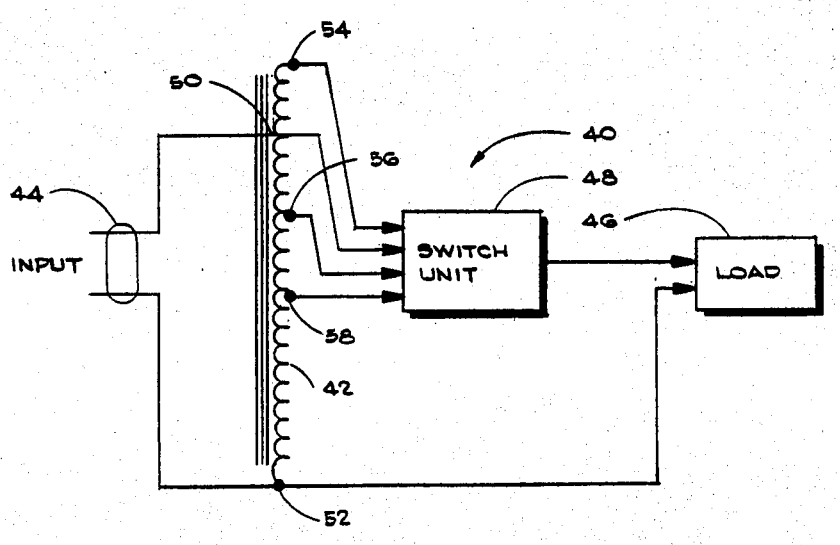
FIG. 2 (PRIOR ART)

Referring now to FIGS. 1 and 2 it will be seen that these figures represent examples of alternative prior art apparatus for control of load power consumption by voltage reduction using an autotransformer and a relay or equivalent short switching device. FIG. 1 is an example of a prior art apparatus in which the switching device is in the input circuit, that is, in series between the input power source and the primary of the autotransformer to control the output voltage. FIG. 2 is an example of an apparatus utilizing an autotransformer and a switching device, the latter being interposed between the secondary of the autotransformer and the load to selectively vary the voltage applied to the load.

FIG. 1 illustrates a prior art apparatus 10 comprising an autotransformer 12, a switch control device 14, a switch 15, a load 16, and an input source 18. In addition, the autotransformer 12 includes a plurality of taps including terminal taps 20 and 22 and intermediate taps 24 and 26. Terminal tap 20 is connected to the load by wire 28 while terminal tap 22 is connected to the load by wire 30. One line of the input source 18 is connected to an intermediate tap 26 of the autotransformer 12 while the other input line is connected to switch 15 by wire 38 which may in turn connect to either terminal tap 20 by means of wire 32 or intermediate tap 24 by means of wire 36.

It will be obvious to those having skill in the art to which the present invention pertains that switch control device 14 and switch 15 act to control the number of windings to which the input power source 18 is applied on the primary of autotransformer 12. Accordingly, the position of switch 15 in effect varies the turns ratio between primary and secondary of autotransformer 12 and thereby effects changes in the voltage applied to the load 16. It will be further understood that in this prior art illustration of FIG. 1, the switch 15, which may be a relay or solid state device or other equivalents well-known in the art, is in the input current path between the input power source 18 and the autotransformer 12 and as such, must be current rated to handle the maximum currents that are expected to flow in the primary side of autotransformer 12.

The prior art apparatus 40 illustrated in FIG. 2 comprises an autotransformer 42, an input source 44, a load 46, and a switch unit 48. In addition, autotransformer 42 comprises a plurality of taps including an input intermediate tap 50, an input terminal tap 52, an output terminal tap 54, an intermediate taps 56 and 58.

It will be understood that in the prior art configuration of FIG. 2, the input voltage to autotransformer 42 is always applied to fixed taps 50 and 52 and switch unit 48 provides the selection of secondary voltage to the load 46. More specifically, switch unit 48 acts to interconnect load 46 to one and only one secondary tap selected from taps 50, 54, 56 and 58 while the load is also connected to fixed tap 52 to complete the secondary load circuit. Obviously, the magnitude of the voltage applied to load 46 will be greatest when the switch unit 48 interconnects the load and transformer tap 54 while that magnitude will selectively decrease in increasing increments as switch unit 48 selects taps 50, 56 and 58, respectively, in that order. Unfortunately, switch unit 48 of prior art apparatus 40 is again in the direct current path between the input source 44 and the load 46 and therefore, also suffers the disadvantage previously discussed, namely, the requirement for a current rating equal to at least the highest anticipated load current on the secondary side of autotransformer 42.

Figure 3:
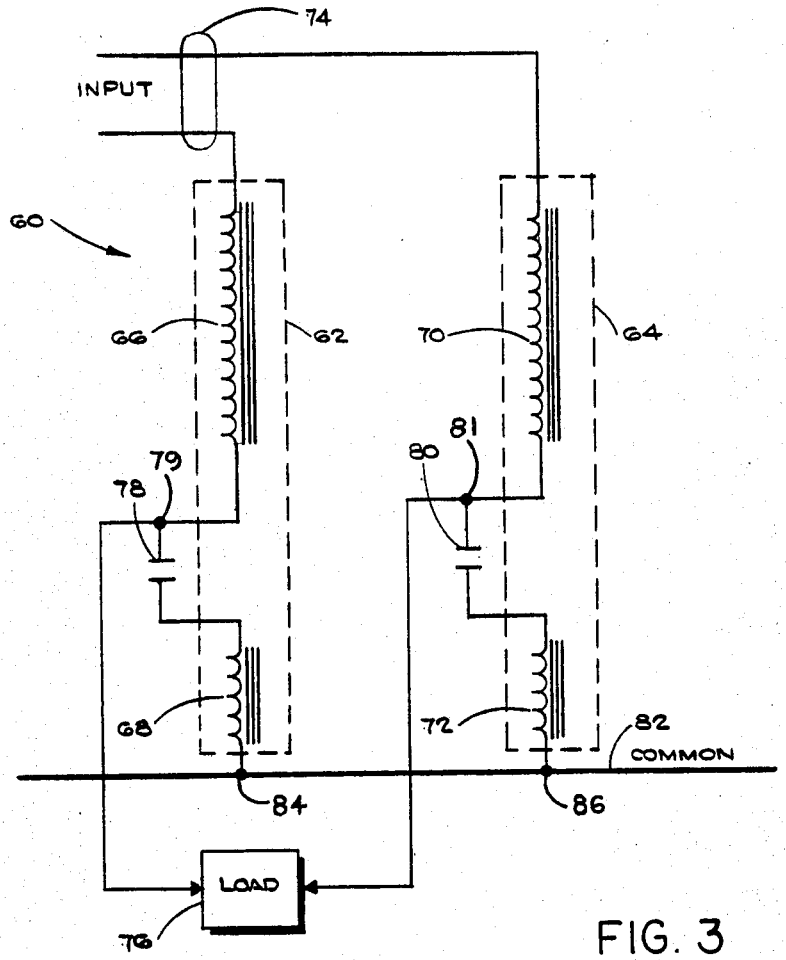
FIG. 3 is a schematic block diagram of a first embodiment of the present invention that is suited for use in a single phase power system.
Figure 4:
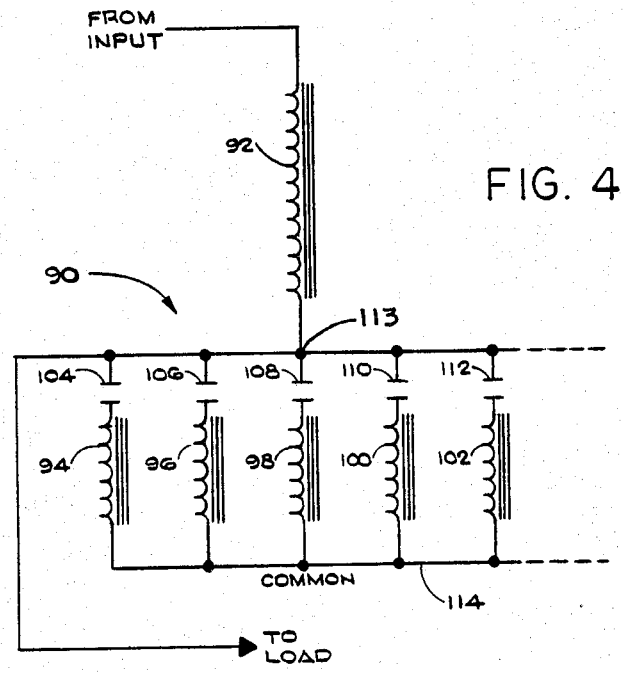
FIG. 4 is a schematic block diagram of an additional embodiment of the invention for selectively varying the low voltage condition.
Figure 5:
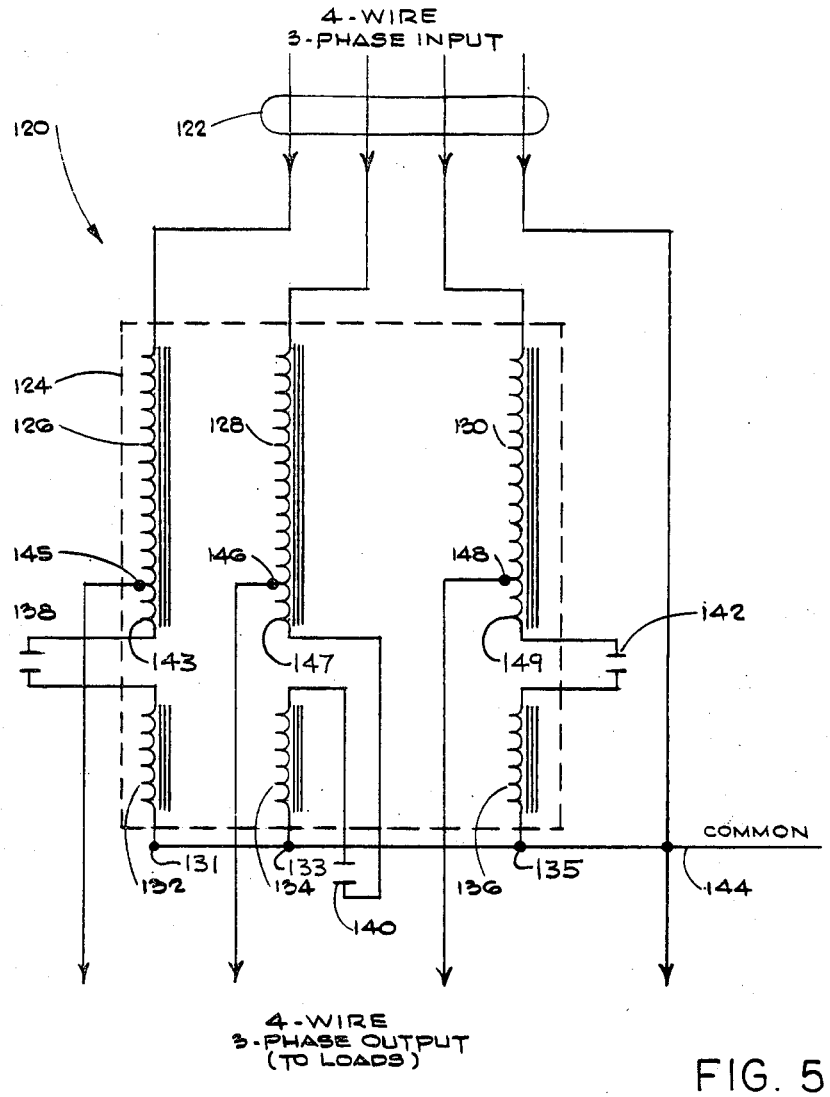
FIG. 5 is an alternative embodiment of the present invention that is especially suited for use in a three phase power system.

Reference will now be made to FIGS. 3–5 for a description of a number of alternative embodiments of the present invention and for illustrating the manner in which the present invention provides a voltage reduction apparatus for decreasing power consumption in a load without the disadvantageous prior art requirement for including a switching apparatus in the direct current path between input power source and the load. More specifically, referring first to FIG. 3, there is shown therein a single-phase apparatus of the invention 60 comprising autotransformers 62 and 64, input source 74, load 76, and relay 78 and 80. It will further be observed that each autotransformer comprises a series winding and a common winding, those terms being used in accordance with the commonly accepted terminology applicable to autotransformers. More specifically, it is seen in FIG. 3 that autotransformer 62 comprises a series winding 66 and a common winding 68 while autotransformer 64 comprises a series winding 70 and a common winding 72. It will also be observed that relays 78 and 80 are respectively interposed in series relation between the common winding and series winding of the respective autotransformer with which each is associated. Thus relays 78 and 80 are connected in series with the respective common windings 68 and 72 of autotransformers 62 and 64, respectively and to respective junctions 79 and 81 to which common windings 66 and 70 are also connected respectively. It will also be observed that the load 76 is connected between junctions 79 and 81 and finally, that the terminals of common windings 68 and 72 respectively are connected to junctions 84 and 86 respectively of the AC common 82.

When relays 78 and 80 are in their normal configuration as shown in FIG. 3, it will be evident that common windings 68 and 72 are disconnected from their respective series windings 66 and 70. In this configuration, the voltage provided by input source 74 is substantially equivalent to the voltage applied to load 76 with the only reduction in voltage being due to the trivial series impedance presented by series windings 66 and 70, respectively. On the other hand, when relays 78 and 80 are actuated and thereby closed, the circuit between junctions 79 and 84 and 81 and 86, respectively, are completed and current is permitted to flow in common windings 68 and 72, respectively. Those having skill in the art to which the present invention pertains will understand that in this latter configuration wherein relays 78 and 80 are closed, the voltage applied to load 76 will be reduced relative to the voltage available at the input source 74. This reduction is effected by the bucking voltage established in common windings 68 and 72 in a well-known manner. More importantly, it will be observed that this voltage reduction is achieved in the present invention by means of relays or equivalent switches which are not in the direct current path between the input source 74 and the load 76.

In the single-phase configuration illustrated in FIG. 3, there are only two voltage levels available to the load 76, namely, the higher nominal input voltage available with relays 78 and 80 in their normally opened configuration and the reduced voltage resulting from the selected closure of relays 78 and 80. However, it will be observed by reference to FIG. 4 that the present invention is readily adapted for providing a plurality of selectable reduced voltage levels to be applied to a load. More specifically, as seen in FIG. 4, an alternative transformer embodiment 90 is illustrated and comprises a series winding 92 and a plurality of common windings 94, 96, 98, 100, and 102 each disposed in series relation with a corresponding relay, namely, relays 104, 106, 108, 110 and 112, respectively. It will be understood that one such alternative embodiment 90 illustrated in FIG. 4 would normally be substituted for each transformer 62 and 64 of the single-phase embodiment illustrated in FIG. 3 in order to accomplish the multiple reduced voltage level selection capability. In operation, the circuit of FIG. 4 behaves in a manner identical to the circuit in FIG. 3 in that the nominal input voltage is applied to the load when all relays 104 through 112 are open. On the other hand, when a specific reduced voltage level is selected, one of relays 104 through 112 would be selectively closed permitting current flow between junction 113 and common 114 through the selected relay and common winding series combination as previously described in conjunction with FIG. 3.

It is to be noted that in the plural common winding configuration of FIG. 4, each of relays 104 through 112 is in the same relative position as previously described relays 78 and 80 of the single reduced voltage level configuration of FIG. 3, namely, outside of the direct current path between the input source and the load. Accordingly, in either configuration, the relays or equivalent switching devices are used to select the reduced voltage configuration and need pass only a small fraction of the load current, the magnitude of that fractional current being dependent upon the selected characteristics of the various common windings in accordance with the well-known electrical parameters of autotransformers. As a result, the current rating, size and cost of the relays or equivalent switching devices may be substantially lower than the corresponding relays or switching devices that would otherwise be in the direct current path between the input and the load as discussed previously in regard to prior art FIGS. 1 and 2.

A three-phase configuration of the present invention is illustrated in FIG. 5. More specifically, as seen in FIG. 5, a three-phase apparatus 120 comprises a four-wire, three-phase input source 122, a three-phase autotransformer 124, and three relays 138, 140 and 142. Three-phase autotransformer 124 comprises respective series windings 126, 128 and 130 and common windings 132, 134 and 136. As in the single-phase configuration of FIG. 3, each of the common windings 132, 134 and 136 is connected in series configuration with a corresponding relay 138, 140 and 142, respectively. However, in this particular three-phase configuration of the present invention, it will be seen that the load junctions 145, 146 and 148 are tapped output junctions from the physical windings including series windings 126, 128 and 130 as well as winding portions 143, 147 and 149. These winding portions are physically connected to the series windings but are electrically connected into the common winding portion of the autotransformer whenever relays 138, 140 and 142 are closed.

This variation between the three-phase and single-phase configurations represented by FIGS. 5 and 3, respectively, is included herein by way of example only to illustrate the sutble variations that may be provided in the embodiments of the present invention while still providing the same resultant operation and the advantages over the prior art.

Figure 6:
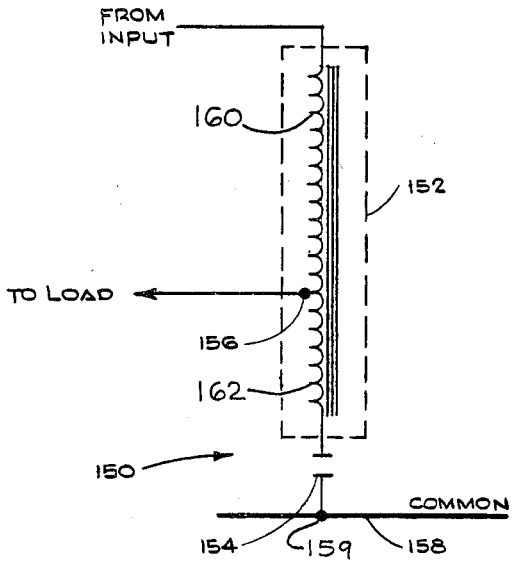
FIG. 6 is a schematic block diagram illustrating an alternative series relationship between a transformer and relay.

It is to be noted that FIG. 6 provides still a further variation of the relative positioning of the transformer windings and the relay. More specifically, in the configuration 150 comprising an autotransformer 152 and a relay 154, it is seen that the transformer comprises a series winding 160 and common winding 162 which form a continuous transformer winding. It is seen further that the output to the load is taken from an intermediate tap 156 which forms the function between the series winding 160 and common winding 162. Finally it is seen that the series relationship between the common winding and the relay 154 is achieved by connecting the relay to common 158 at junction 159, which therefore requires "breaking the AC common".

Although the embodiment illustrated in FIG. 6 is electrically similar to the embodiments of FIGS. 3, 4 and 5 previously discussed, the position of relay 154 is prohibitively disadvantageous from the standpoint of gaining agency approval for an electrical load system using the configuration of FIG. 6. More specifically, the position of relay 154 immediately adjacent the common 158 at junction 159 is deemed by most agencies to be a configuration which breaks the common when relay 154 is in its normally open position. Breaking the common is frowned upon by these agencies as a violation of their rules for approval. Accordingly, the configuration of FIG. 6 is not suitable for carrying out the present invention, and no invention is claimed in the configuration of FIG. 6.

Referring back to FIG. 5, it is to be noted that each of the common windings 132, 134 and 135 is connected to the common 144 at junctions 131, 133 and 135 respectively so that the effect of opening and closing the series relays 138, 140 and 142, in each of the output phases of apparatus 120 is the equivalent of the apparatus 60 described previously in conjunction with FIG. 3. In all cases, the series relay is positioned to control the output voltage to the load without being in the direct path of current between the input power source and the load as previously described in conjunction with prior art FIGS. 1 and 2.

It will now be understood that what has been disclosed herein is an apparatus for the selective reduction of voltage applied to a load such as a lighting load for purposes of reducing power consumption. The invention employs the unique concept of utilizing an apparatus in which an autotransformer is connected in series with a switching device such as a relay. More specifically, a portion of the autotransformer winding is interposed between the input and output and an additional portion of the transformer winding is interposed between the output and the common terminal of an alternating current power system. A relay or equivalent switching device is connected in series with the common winding so that when the relay or equivalent switching device is in its normally open configuration, no current can flow in the common winding and the output voltage is substantially equivalent to the input voltage less any nominal voltage drop across the relatively low impedance of the series winding. On the other hand, when the relay or equivalent switching device is closed, the current is permitted to flow in the common winding and the transformer performs its normal function as an autotransformer with the output voltage reduced relative to the input voltage in accordance with the well-known operation of an autotransformer. This unique placement of the switching device relative to the autotransformer as compared to the prior art, namely, outside the direct path of the load current on either side of the transformer, substantially reduces the necessary current handling capacity of the relay or equivalent switching device thereby substantially reducing the size and cost of such switching devices.

It will also be understood that various alternative embodiments of the present invention have been disclosed including one embodiment that permits the selection of any one of a plurality of different reduced voltage levels while still providing the advantageous reduced current operation that affords the aforementioned advantages of the present invention as compared to the prior art.

Those having skill in the art to which the present invention pertains will now, with the benefit of applicants' teaching herein, realize that various modifications and additions may be made to the present invention to achieve the aforementioned purpose in various alternative ways or to increase the flexibility for voltage control using the invention. By way of example, it will now be apparent that the series relationship of the common winding and switching device of the present invention may be combined with a tapped configuration for the series winding of the autotransformer used herein to achieve additional flexibility and voltage control. However all such modifications and additions are deemed to be within the scope of the present invention which is to be limited only by the claims appended hereto.

We claim:

1. An apparatus for selectively reducing the voltage applied from an input to a load in an AC power system of the type having an AC common, the apparatus comprising:

an autotransformer having a series winding and a common winding, the series winding being connected between the input and the load, the common winding being connected between the load and AC common, and a switching device connected in series with said common winding for preventing the flow of current in said common winding for applying full voltage to said load, and for permitting the flow of current in said common winding for reducing the voltage to said load, said switching device being electrically isolated from said AC common by at least a portion of said common winding.

2. The apparatus recited in claim 1 comprising at least two such autotransformers and switching devices, one autotransformer and switching device connected respectively in each power line to which the load is connected.

3. The apparatus recited in claim 1 wherein said autotransformer comprises a plurality of parallel common windings of unequal characteristics and wherein said apparatus comprises a plurality of switching devices, one such switching device being connected in series with each common winding for selection from a plurality of reduced voltages to apply to said load.

4. The apparatus recited in claim 1 wherein said switching device is connected between said common winding and said series winding.

5. The apparatus recited in claim 1 wherein said common winding comprises two distinct portions and wherein one such portion is connected between said switching device and said AC common.

6. The apparatus recited in claim 1 wherein said common winding comprises a first winding extending from said series winding and a second winding physically separate from said series winding.

7. The apparatus recited in claim 6 wherein said switching device is connected between said first and second windings.

8. The apparatus recited in claims 1, 2, 3, 4, 5, 6, or 7 wherein each said switching device comprises a relay in its open condition when deactivated and in its closed condition when activated.

9. The apparatus recited in claims 1, 2, 3, 4, 5, 6, or 7 wherein said load comprises a plurality of fluorescent lights.

10. An apparatus for selectively reducing the voltage applied from an input to a load in an AC power system of the type having an AC common, the apparatus comprising a switching device connected between the load and AC common for reducing the voltage applied to the load without passing full load current, the switching device being isolated from AC common by at least a portion of the common winding of an autotransformer.

* * * * *